US005641034A

United States Patent [19]

Calmeise et al.

[11] Patent Number: 5,641,034

[45] Date of Patent: Jun. 24, 1997

[54] STEP STOOL HAVING INTEGRAL SIDE STORAGE COMPARTMENTS

[75] Inventors: Randall W. Calmeise, Oakwood Village; David L. O'Neal, North Canton, both of Ohio

[73] Assignee: Rubbermaid Incorporated, Wooster, Ohio

[21] Appl. No.: 423,464

[22] Filed: Apr. 19, 1995

[51] Int. Cl.[6] ..... A47C 13/00

[52] U.S. Cl. ..... 182/33; 182/222; 182/17

[58] Field of Search ..... 182/33, 222, 17, 182/180; D6/336, 349; 297/423.41, 461, 118, 188.01

[56] References Cited

U.S. PATENT DOCUMENTS

| | | | |
|---|---|---|---|
| D. 101,895 | 11/1936 | Stoddard | D6/336 |
| D. 131,473 | 3/1942 | Therlander | D6/349 X |
| D. 139,325 | 6/1944 | Gass | D6/349 |
| D. 173,074 | 9/1954 | McMaster | D6/336 |
| D. 181,793 | 12/1957 | Hansen | D9/2 |
| D. 271,256 | 11/1983 | McClelland | D6/32 |
| D. 276,861 | 12/1984 | Keddie | D6/336 |
| D. 279,238 | 6/1985 | Ferdinand et al. | D6/350 |
| D. 284,911 | 8/1986 | Lemmeyer | D6/349 |
| D. 287,434 | 12/1986 | Wolfe et al. | D6/336 |
| D. 295,001 | 4/1988 | Ferdinand et al. | D6/336 |
| D. 298,674 | 11/1988 | Koller, Sr. | D6/336 X |
| D. 307,800 | 5/1990 | Hradisky | D25/65 |
| D. 314,472 | 2/1991 | Brantingham et al. | D6/336 X |
| D. 327,352 | 6/1992 | Robinson | D34/23 |
| D. 330,462 | 10/1992 | Szablak et al. | D6/350 |
| D. 335,966 | 6/1993 | Schwartzkopf et al. | D6/350 |
| D. 337,211 | 7/1993 | Bergkvist | D6/349 |
| D. 346,704 | 5/1994 | Grosfillex | D6/349 |
| D. 347,527 | 6/1994 | Breen et al. | D6/349 |
| D. 351,476 | 10/1994 | Grosfillex | D25/63 |
| D. 351,508 | 10/1994 | Bonazza | D6/336 |
| D. 351,950 | 11/1994 | Bird et al. | D6/351 |
| D. 354,210 | 1/1995 | Dickinson et al. | D8/71 |
| D. 355,828 | 2/1995 | Dickinson et al. | D8/71 |
| D. 357,119 | 4/1995 | Calmeise et al. | D3/308 |
| D. 367,967 | 3/1996 | Calmeise et al. | D6/336 |
| 1,973,628 | 9/1934 | Hindle | 182/33 X |
| 1,986,563 | 1/1935 | Eberhardt | 297/423.41 X |
| 2,069,476 | 2/1937 | Keil | 297/423.41 X |
| 2,446,601 | 8/1948 | Lelyveld | 297/188.01 X |
| 2,491,671 | 12/1949 | Lister | 155/2 |
| 2,667,658 | 2/1954 | Cornick | 297/423.41 X |
| 2,681,809 | 6/1954 | Hamill | 280/12 |
| 2,950,753 | 8/1960 | Gleitsman et al. | 155/169 |
| 3,099,398 | 7/1963 | Croteau | 240/4 |
| 3,233,940 | 2/1966 | Tooley, Jr. | D6/336 X |
| 3,656,809 | 4/1972 | Ronning | 297/461 |
| 4,067,607 | 1/1978 | Battles | 297/192 |
| 4,276,955 | 7/1981 | Hickman | 182/33 |
| 4,366,998 | 1/1983 | Kaiser | 312/235 |
| 4,458,963 | 7/1984 | Keddie | 312/237 |
| 4,541,539 | 9/1985 | Matthews | 220/20 |
| 4,744,613 | 5/1988 | Brantingham et al. | 312/235 |
| 4,832,355 | 5/1989 | Hung | 182/33 X |
| 5,350,215 | 9/1994 | DeMars | D6/336 X |

OTHER PUBLICATIONS

Pages 771, 712 and 713, Stools; Popular Mechanics, address unknown. Publication date 1938.

Sell sheet, Stool; Cramer, Inc., 625 Adams Street, Kansas City, Kansas 66105. Publication date date Oct. 13, 1986.

Page 7, Euro Stool; Dupol–Rubbermaid GmbH, An der Trift 63, D06072 Dreieich, West Germany. Publication date 1989.

*Primary Examiner*—Terry Lee Melius
*Assistant Examiner*—Victor Batson
*Attorney, Agent, or Firm*—Richard B. O'Planick; Lisa B. Riedesel

[57] ABSTRACT

A stepstool (10) is disclosed having a central planar top platform (14), four support legs (20,22,24,26) for supporting the platform, and a pair of storage receptacles (36,38) extending outward in cantilever fashion from opposite sides of the stool. The receptacles (36,38) are open at the top to accommodate receipt of tall bottles or the like, and act as counterbalancing weight with which to stabilize the stool against tipping. The stepstool receptacles hang above floor level a nominal distance so as not to interfere with level positionment of the stool upon the floor surface.

20 Claims, 5 Drawing Sheets

STEP STOOL HAVING INTEGRAL SIDE STORAGE COMPARTMENTS

BACKGROUND OF THE INVENTION

1. Field of the Invention

The subject invention relates generally to molded plastic stepstools and, more particularly, stepstools having integral storage compartments for the storage and transport of small articles.

2. The Prior Art

Stepstools having integral storage compartments are well know in the art. Such articles are typically formed of plastic material and comprise a central storage compartment suspended between four molded plastic legs. The storage compartment is enclosed at the top by a pivoting lid that also serves, in the down position, as a support platform for the stool. The lid has a handle pivotally attached to the top surface by which to transport the stepstool from location to location and job to job. Such products find application in elevating users a distance above the floor surface for performing various chores.

U.S. Pat. Nos. 347,527 and 4,744,613 show state of the art stepstools having integral, centrally disposed storage receptacles. Such products are well accepted and have met with commercial success. However, several shortcomings in available stepstools have prevented them from solving all of the market's needs.

First, step stools having a central storage compartment enclosed by a pivoting lid require the user to step off the stool in order to open the lid and access the contents of the compartment. This procedure is rather cumbersome, particularly when the nature of the task requires repeated access to the storage compartment.

Secondly, stepstools having a central storage compartment, a pivoting lid, and a pivoting handle are relatively expensive and, therefore, for cost reasons are less than optimal. Moreover, the central compartments of such stepstools are generally not very deep, thereby preventing them from storing tall objects such as cleaning bottles. Also, fully loaded, commercially available stepstools are relatively heavy, and are therefore cumbersome to carry over a substantial distance Even unloaded, such stepstools because of their construction are relatively heavy and can be awkward to repeatedly carry from job site to job site.

Another deficiency in conventional stepstools is that a user can cause the stepstool to tip under certain conditions. The weight of the stepstool and its contents can be overcome by a user leaning out over side legs of the stool, causing the stool to tip in that direction. Thus, from a safety standpoint, such stepstools represent a less than optimal product to the end user.

SUMMARY OF THE PRESENT INVENTION

The subject invention overcomes the aforementioned deficiencies in conventional stepstool toolboxes by providing a lightweight stepstool having integral side storage receptacles. The receptacles are open at the top to accommodate receipt of tall articles such as cleaning bottles, and articles stored therein can be accessed without stepping down from the central platform and without the need to manipulate a lid.

The subject invention comprises an integrally molded body having a central top platform and a peripheral skirt extending downward from peripheral edges of the platform. Four support legs are connected at upper ends to the top platform and have bottom ends for positionment upon a floor surface, whereby elevating the platform a step above the floor surface.

A pair of storage receptacles are provided, each extending in cantilever fashion from opposite sides of the dependent skirt. Each receptacle is unlidded forms an upwardly open compartment capable of receiving relatively tall articles for storage and transport. Each receptacle acts as a counterbalance to tipping of the stepstool body in a direction away from the receptacle, whereby enhancing the tipping stability of the step stool.

In addition, a lower surface of each receptacle is elevated a nominal distance above the lower ends of the support legs with the receptacle in an unloaded condition. Thus, the receptacle bottom surface engages the floor surface when the stepstool body begins to tip in the direction of the receptacle and the receptacle acts as a positive stop against tipping in that direction.

Accordingly, it is an objective of the present invention to provide a lightweight portable stepstool having integral storage compartments capable of accommodating relatively tall objects.

A further objective is to provide a stepstool having integral storage compartments and integral means for deterring the stepstool from tipping over the support legs.

Yet a further objective is to provide a stepstool having integral counterbalancing means for tipping stability.

Still a further objective is to provide a stepstool having integral storage compartments accessible to a user from a position upon the stepstool. Another objective is to provide a stepstool having a light carry weight in the unloaded condition.

A still further objective is to provide a stepstool having integral storage capability requiring no assembly and no assembly hardware.

These, and other objectives, which will be apparent to those skilled in the art, are achieved by a preferred embodiment which is described in detail below and which is illustrated in the accompanying drawings.

DESCRIPTION OF THE ACCOMPANYING DRAWINGS

DESCRIPTION OF THE PREFERRED EMBODIMENT

Figure 1:
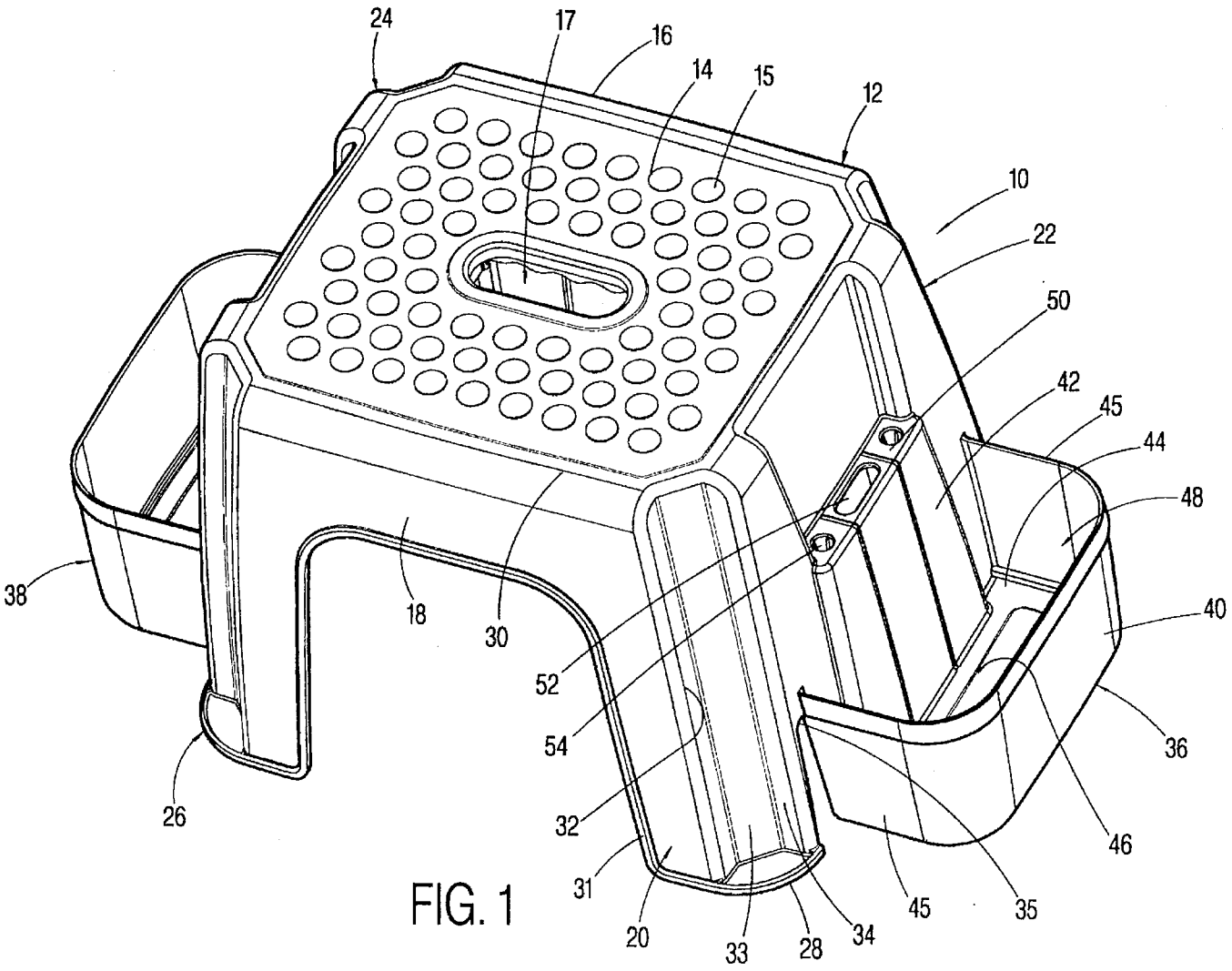
FIG. 1 is a front perspective view of the subject stepstool.
Figure 2:
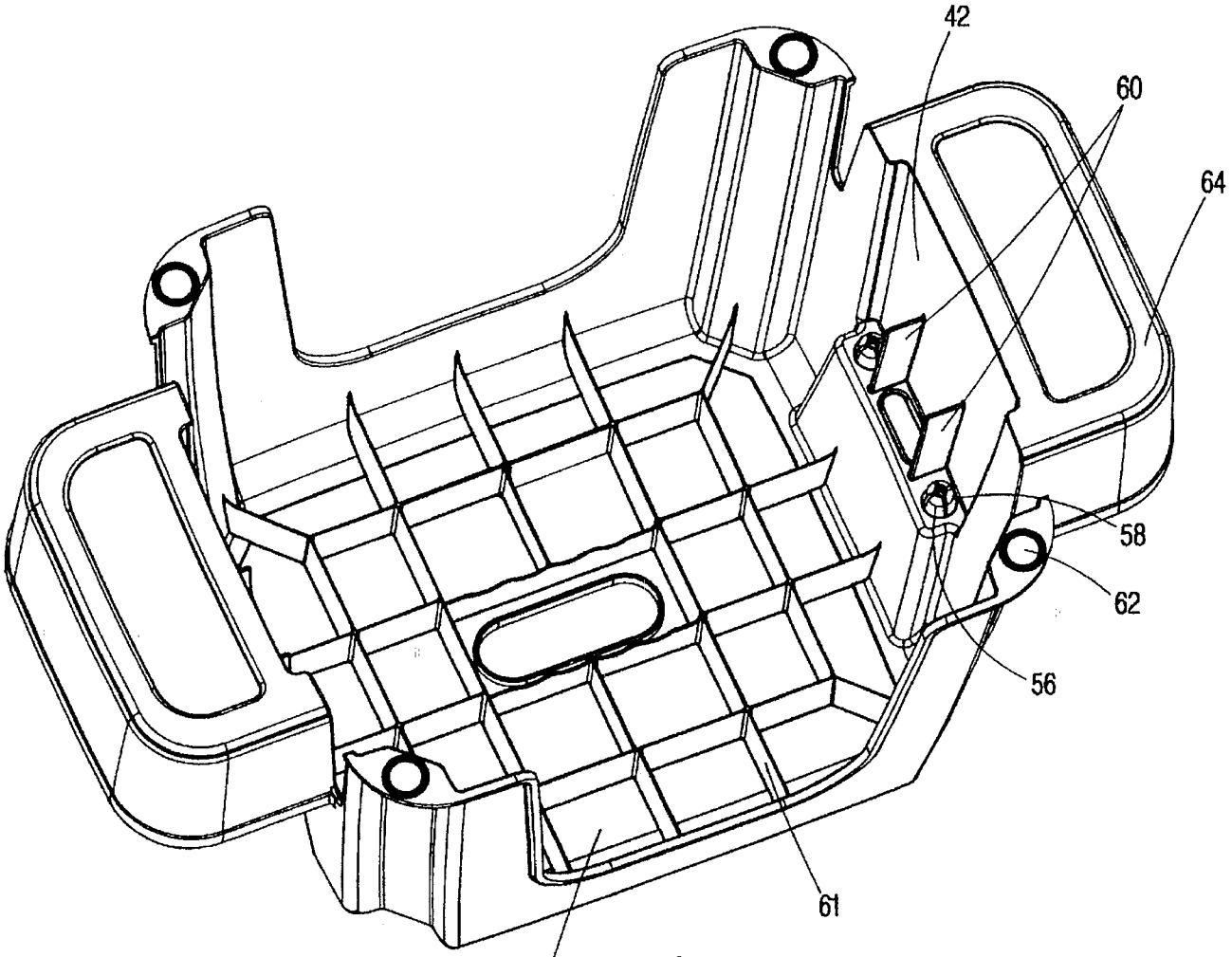
FIG. 2 is a bottom perspective view thereof.
Figure 3:
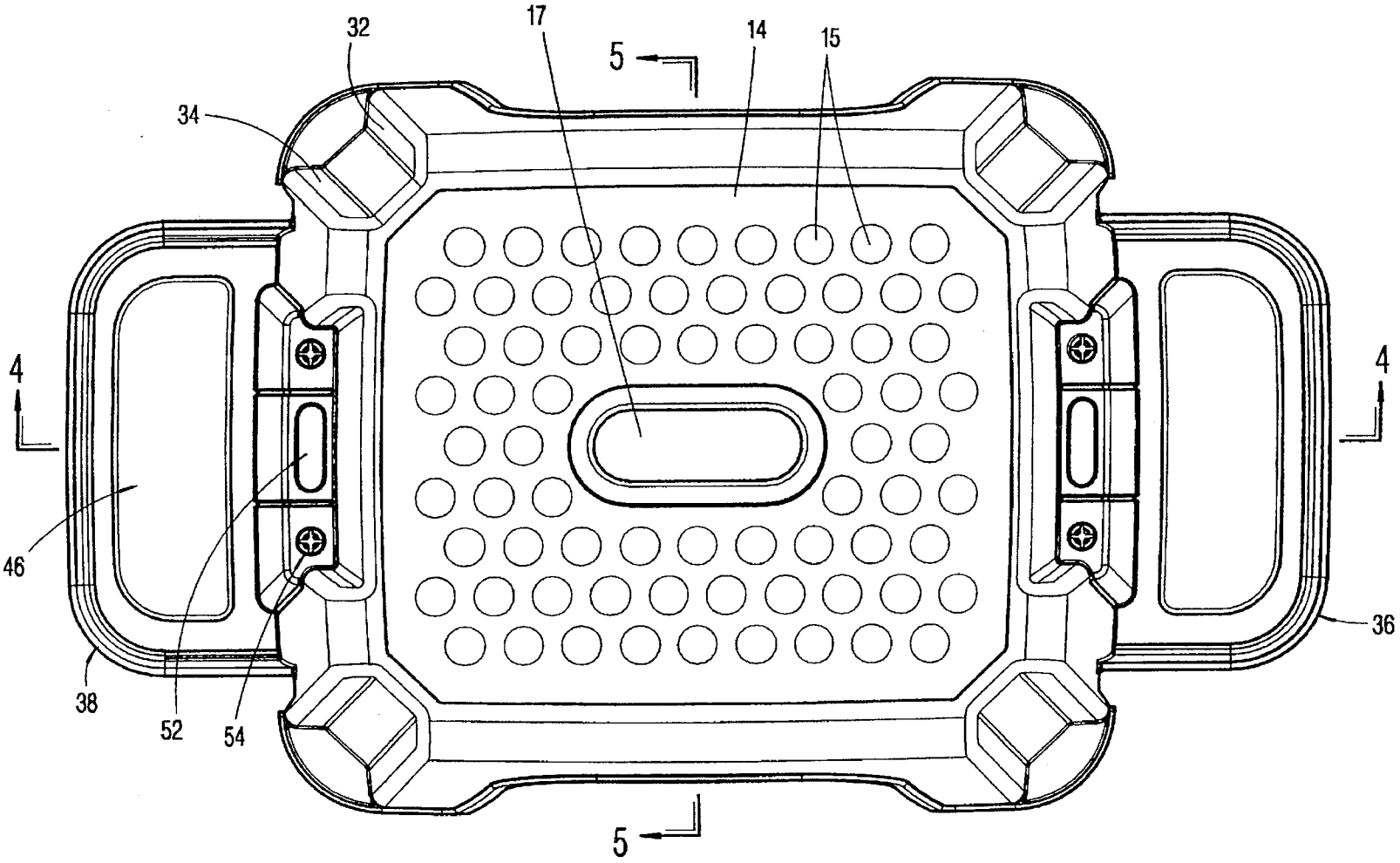
FIG. 3 is a top plan view thereof.

Referring first to FIGS. 1, 2, and 3, the subject stepstool 10 is shown to comprise an integrally molded body 12, formed of conventional plastics material such as polyethylene by conventional processing such as injection molding. The part 10 is of unitary construction requiring no assembly and no assembly hardware.

The component elements of the body 12 are depicted to include an upraised, flat topped platform 14 having a pattern of dimple indentations 15 formed therein to provide a user with greater traction. The platform 14 is generally square and is flat on the top for use as a standing surface as with conventional stepstools. The platform to surface is level and uninterrupted so that a user will not stumble and fall. The top of the platform terminates at outward peripheral edge portions 16 and an oblong hand opening 17 extends through the center of the platform 14 so as to enable a user to manually grasp and carry the stepstool from work site to work site. An outwardly flaring skirt 18 extends downward in dependent fashion from the peripheral edge portions 16, extending lower at two opposite sides of the body 12 for a purpose explained below.

The body 12 is provided with four support legs, 20, 22, 24, and 26, each having a lower end support pad 28 and an upper end 30 connecting to a respective corner of the platform 14. The support legs as shown are of generally W-shaped cross-section, each having an inner edge portion 31, convergent surface portions 32, 34, a bridging portion 33, and an outer edge portion 35. The legs flare outward from the top platform 14.

A pair of storage receptacles 36, 38 are provided at opposite sides of the body 12, each receptacle comprising a C-outward wall 40, an inward wall 42, a floor 44, and sidewalls 45. The floor 44 is formed having a central opening 46 therein. The sidewalls 45 and walls 40, 42 extend upwardly from the floor 44 to define a storage compartment 48 therebetween. It will be appreciated that the inward wall 42 of each receptacle 36, 38 is a lower portion of the peripheral skirt 18, extending between two support legs 20, 22 on one side, and 24, 26 on the opposite side. Each receptacle extends outward from skirt 18 in cantilever fashion, between the associate two support legs.

It will be seen that the tops of the receptacles 36, 38 are open, allowing receipt of articles into compartments 48. Relatively tall articles, such as bottles of cleaning fluid, can thus be placed upon the floor 44 and extend upward therefrom unencumbered by a lid or other obstruction. The receptacles 36, 38 are conveniently located adjacent the platform 14 so that a user, standing on the platform, can reach downward and insert and withdraw articles from the storage receptacles 36, 38 without stepping from the platform. The receptacles therefore provide convenient storage of articles that a user requires in the performance of common tasks.

The receptacles (36, 38) hang proximate to the floor but nominally spaced thereabove. So suspended, the receptacles do not contact the floor and therefore do not interfere with the stool achieving a level support on its support legs. The symmetric placement of two receptacles on opposite sides of the stool body acts to balance the stool for easy lifting and carrying. The stool is grasped manually by a user placing a hand through opening 17 and underneath the edge defining such opening. The stool can then be lifted and relocated. Once placed upon a surface, the stool is supported only by the support legs with the receptacles (36, 38) hanging in suspension above the floor surface.

Figure 5:
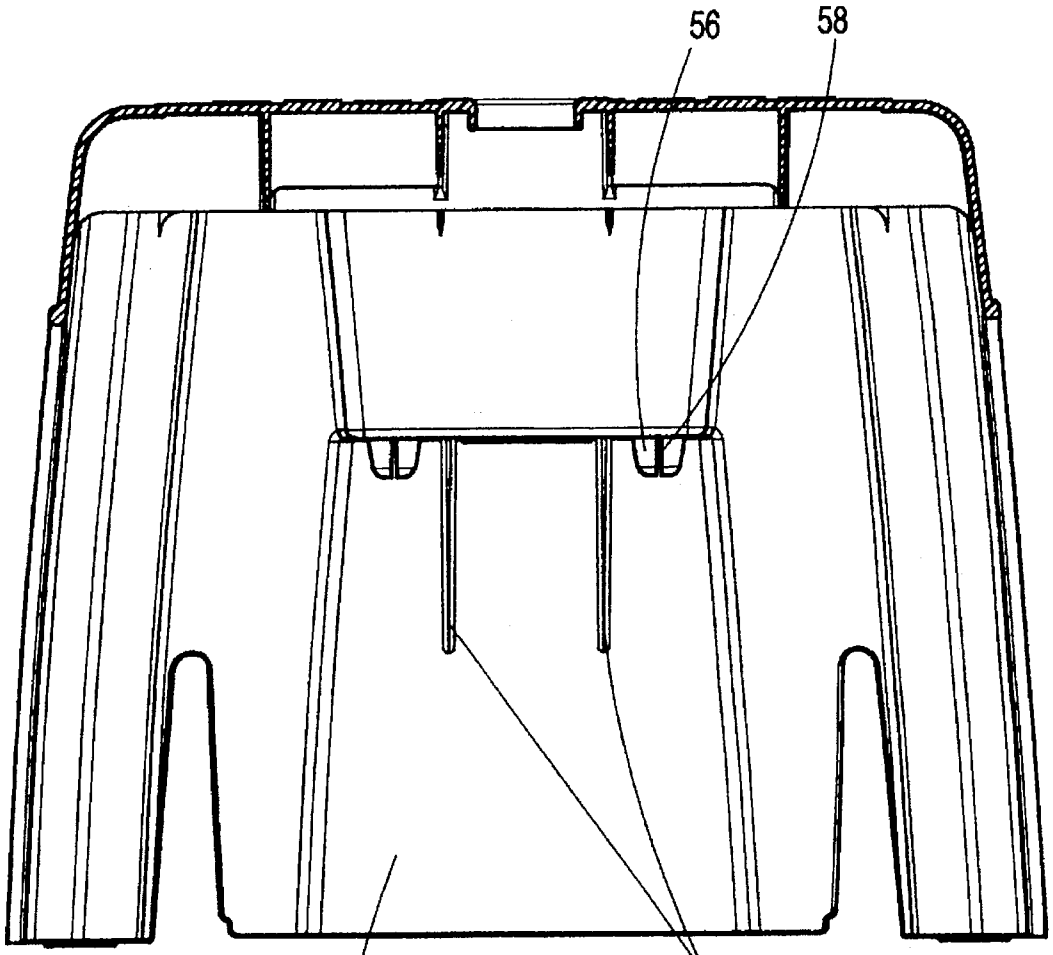
FIG. 5 is a transverse section view thereof taken along the line 5—5 of FIG. 3.

Continuing with reference to FIGS. 1, 2, and 3, the inward wall 42 of each receptacle 36, 38 steps inward midway between its top and bottom, along a horizontal ledge surface 50. Extending through the surface 50 is a central oblong aperture 52 and a pair of circular apertures 54. The purpose of the apertures 52 and 54 is to receive the handle portions of inverted tools such as screwdrivers, for storage and use. As shown in FIGS. 2 and 5, a pair of truncated conical sockets 56 extend downward from the circular apertures 54, each socket 56 split into sections by vertical slits 58. The sockets 56 flex outward as the handle of a tool is inserted therein and clasp about the handle to securely retain the tool within the socket.

A pair of internal reinforcement flanges 60 extend vertically along the interior side of the inward receptacle wall from opposite ends of the oblong aperture 52 downward. The flanges 60 reinforce the inward wall, providing sufficient strength to support a fully loaded receptacle. A grid of additional reinforcement flanges 61 are molded into the underside of the platform 14, adding additional strength to the platform.

Figure 4:
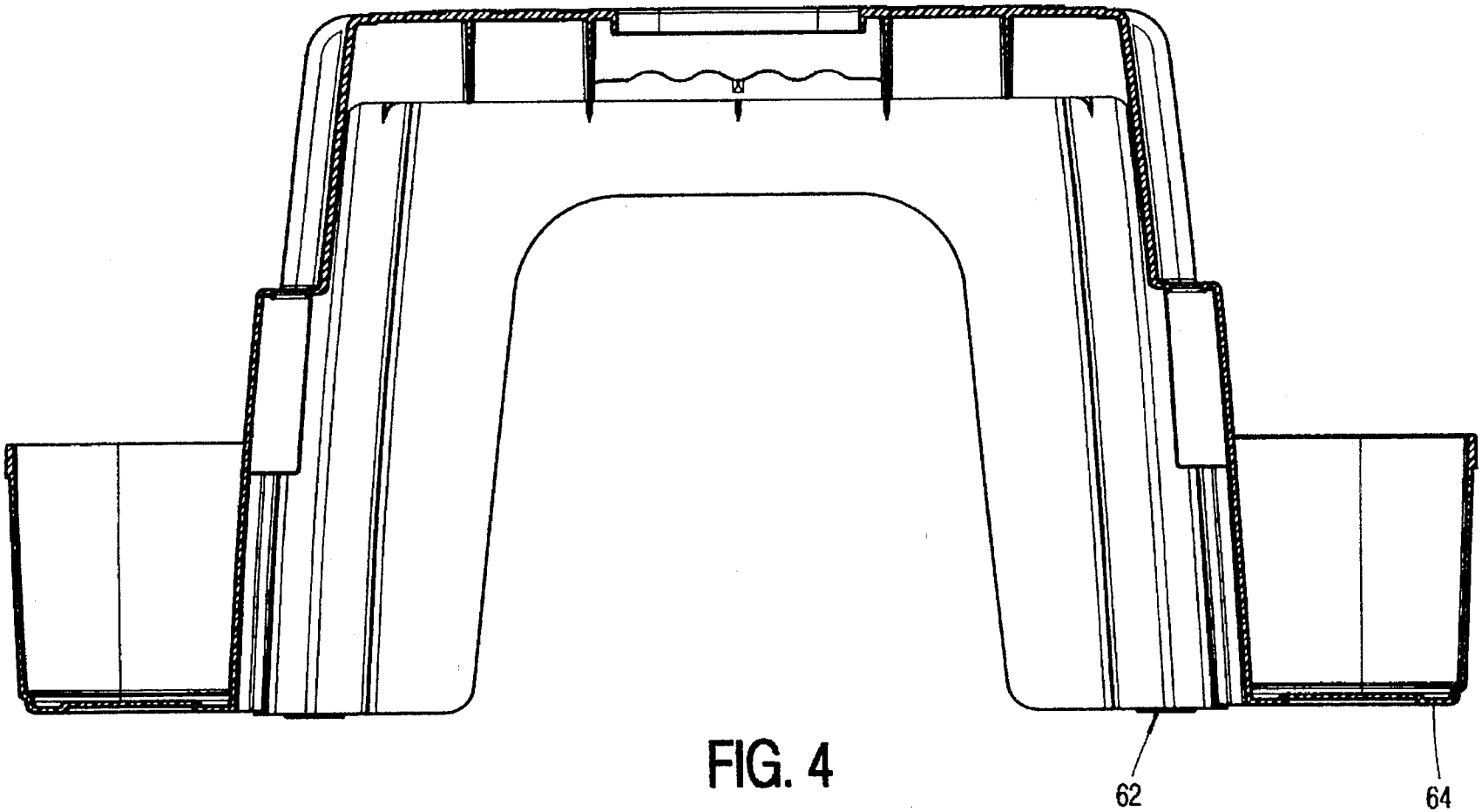
FIG. 4 is a longitudinal section view thereof taken along the line 4—4 of FIG. 3.

Referring next to FIGS. 1, 2, and 4, it will be seen that pad members 62 are affixed to the bottoms of the support legs 20–26 by adhesive preferably, or by mechanical means if so desired. The bottom surface 64 of each receptacle 36, 38 is vertically positioned nominally above the pad members 62 such that the receptacles 36, 38 will not contact the floor surface on which the pad members 62 rest. The receptacles 36, 38 thus project outward in cantilever fashion from opposite sides of the dependent skirt 18, with a bottom surface of the receptacles spaced nominally above the bottom of the stepstool legs.

It will be appreciated that, in the loaded condition particularly but even in the unloaded state, the receptacles 36, 38 add stability to the stepstool. Located low and to the side of the standing platform 14, the receptacles lower the center of gravity and make tipping less likely to occur. Moreover, each receptacle is located a substantial distance from the pair of support legs at the opposite side of the stepstool, maximizing its effective counterbalancing force moment to the stepstool tipping over those two support legs. The placement of two symmetric receptacles to the stool accordingly stabilizes the stool from tipping in either direction. And, should the stool begin to tip over either side, the receptacle at that side will contact the floor and terminate movement of the stool in that direction.

The presence of the opening 46 in the bottom floor 44 of each receptacle 36, 38 makes the receptacle components relatively light weight. Unloaded, the receptacles 36, 38 therefore only marginally increase the weight of the overall stool, making it light to transport from place to place. Moreover, the compartments 48, as described above, are open and can be accessed from a user's position upon the stool enhancing the stool's utility. Finally, the stool is of one piece construction integrally formed and requiring no assembly or assembly hardware. This minimizes the manufacturing cost of the stool and thereby further enhances its utility and commercial appeal.

While the above describes the preferred embodiment of the subject stepstool, the invention is not intended to be so limited. Other embodiments, which will be obvious to one skilled in the art and which utilize the teachings herein set forth, are intended to be within the scope and spirit of the subject invention.

We claim:

1. A stepstool having integral storage means, comprising:

an integral body having a central top platform and a peripheral skirt extending downward from peripheral edges of the platform;

a plurality of spaced apart support legs supporting opposite sides of the platform therebetween in an elevated position, each of the support legs having an upper end connected to the platform and a lower end for positionment upon a floor surface, whereby supporting the body in an upright condition; and at least one storage receptacle located between and extending outwardly beyond a first and a second support leg at one side of the stepstool body, and the receptacle being connected to the peripheral skirt at an inward side and extending outward therefrom in cantilever fashion, the receptacle having a bottom surface positioned to contact the floor surface to stop destabilizing tipping of the stepstool body in the direction of the receptacle.

2. A stepstool according to claim 1, wherein the storage compartment has a floor surface and an inward side, an outward side, and spaced apart sidewalls extending upward from the floor surface and defining therebetween an internal storage chamber for receipt and retention of storage articles.

3. A stepstool according to claim 2, wherein the platform skirt extends between the first and the second support legs.

4. A stepstool according to claim 3, wherein the inward side of the storage receptacle comprises a lower portion of the platform skirt.

5. A stepstool according to claim 1, wherein the receptacle counterbalances tipping movement of the stepstool body in a direction away from the receptacle.

6. A stepstool according to claim 5, wherein the storage receptacle is positioned between the lower portions of the first and second support legs at the one side of the stepstool, and the receptacle bottom surface is elevated a nominal distance above the lower ends of the support legs.

7. A stepstool according to claim 6, further comprising a complimentary, like-configured second storage receptacle at a side opposite to the one side of the stepstool body.

8. A stepstool according to claim 7, wherein the second receptacle counterbalances tipping movement of the stepstool body in a direction away from the second receptacle.

9. A stepstool having integral storage means, comprising:

an integral body having a raised central top platform, a skirt portion depending downward from peripheral edges of the top platform, a plurality of spaced apart support legs for supporting the platform, each leg having an upper end connected to a respective corner of the platform and a lower end for positionment upon a floor surface; and at least one upwardly opening storage receptacle located outward of the support legs at one side of the stepstool, the receptacle extending from the skirt in cantilever fashion and a bottom surface of the receptacle is positioned to engage the floor surface to deter tipping of the stepstool body in the direction of the receptacle.

10. A stepstool according to claim 9, wherein the receptacle further comprising a floor surface and an outward wall, an inward wall, and spaced apart sidewalls extending upward from the bottom surface and defining therebetween a compartment for receipt and storage of articles.

11. A stepstool according to claim 10, wherein the inward receptacle wall comprises an integrally formed lower portion of the stepstool body skirt.

12. A stepstool according to claim 10, wherein the receptacle extends between lower portions of first and second support legs at one side of the stepstool body, and the receptacle bottom surface is elevated a nominal distance above the lower ends of the support legs.

13. A stepstool according to claim 12, wherein the receptacle counterbalancing tipping movement of the stepstool body in a direction away from the receptacle.

14. A stepstool according to claim 13, wherein the top platform having a digit sized aperture extending therethrough for facilitating manual grasping and relocation of the stepstool.

15. A stepstool according to claim 13, wherein the inward wall of the receptacle has a transversely extending, horizontal ledge surface formed therein between a lower end and an upper end, and the ledge surface having at least one aperture extending therethrough for handle-first receipt of a hand tool for storage.

16. A stepstool having integral storage means, comprising:

an integral body having a flat top platform, the platform having a plurality of corners and peripheral edge portions and a skirt portion depending downward from the peripheral edges of the top platform, a plurality of spaced apart support legs for supporting a like plurality of the corners of the platform in an elevated position, each leg having an upper end connected to a respective corner of the platform and a lower end for positionment upon a floor surface; at least one upwardly opening storage receptacle having an inward side connected to the peripheral skirt portion and extending therefrom in cantilever fashion between a first support leg and a second support leg, the receptacle projecting outward substantially beyond the first and second support legs, whereby counterbalancing the stepstool body from tipping in a direction away from the receptacle.

17. A stepstool according to claim 16, wherein the receptacle is connected to a lower portion of the skirt portion and the receptacle has a bottom surface that is elevated a nominal distance above the lower ends of the support legs.

18. A stepstool according to claim 17, wherein the receptacle is positioned to engage the floor surface upon tipping movement of the stepstool body toward the receptacle whereupon the receptacle prohibits further tipping movement of the stepstool body.

19. A stepstool according to claim 16, wherein the receptacle having a floor surface and an outer wall, an inward wall, and sidewalls extending upward from the floor surface and defining therebetween a storage compartment substantially open at a top end.

20. A stepstool according to claim 17, wherein the stepstool body having a complimentary like-configured second receptacle positioned to extend in cantilever fashion from the peripheral skirt portion at an opposite side of the stepstool body.

* * * * *